US006332841B1

(12) United States Patent
Secord

(10) Patent No.: US 6,332,841 B1
(45) Date of Patent: Dec. 25, 2001

(54) FLOATING CUSHION SUB

(75) Inventor: Douglas C. Secord, Calgary (CA)

(73) Assignee: Foremost Industries, Inc., Calgary (CA)

( * ) Notice: Subject to any disclaimer, the term of this patent is extended or adjusted under 35 U.S.C. 154(b) by 0 days.

(21) Appl. No.: 09/486,551

(22) PCT Filed: Sep. 9, 1998

(86) PCT No.: PCT/CA98/00850

§ 371 Date: Feb. 29, 2000

§ 102(e) Date: Feb. 29, 2000

(87) PCT Pub. No.: WO99/15757

PCT Pub. Date: Apr. 1, 1999

(30) Foreign Application Priority Data

Sep. 25, 1997 (CA) ..... 2216498

(51) Int. Cl.[7] ..... E21B 17/02

(52) U.S. Cl. ..... 464/20; 464/89; 464/18; 175/321

(58) Field of Search ..... 464/18, 20, 19, 464/74, 76, 92, 89, 90, 91; 175/321

(56) References Cited

U.S. PATENT DOCUMENTS

| | | |
|---|---|---|
| 3,779,040 | 12/1973 | Garrett . |
| 4,055,338 | 10/1977 | Dyer . |
| 4,109,488 | 8/1978 | Work . |
| 4,192,155 | 3/1980 | Gray . |
| 4,571,215 | 2/1986 | Hansen . |
| 4,759,738 | 7/1988 | Johnson . |
| 5,224,898 | 7/1993 | Johnson et al. . |
| 5,476,421 | 12/1995 | Moore et al. . |
| 5,588,916 | 12/1996 | Moore . |

FOREIGN PATENT DOCUMENTS

| | | |
|---|---|---|
| 12 19 855 | 3/1987 | (CA) . |

*Primary Examiner*—Lynne H. Browne
*Assistant Examiner*—Aaron Dunwoody
(74) *Attorney, Agent, or Firm*—Miles & Stockbridge P.C.; John C. Kerins

(57) ABSTRACT

A cushion sub for absorbing both axial and torsional vibration in a drill string and including an outer casing connectable at one end to a section of a drill string, and an inner piston reciprocally mounted in a cylinder within the casing, the piston having a shaft projecting from the other end of the casing connectable to another section of the drill string. The cylinder includes a first cushion device at opposite ends thereof for engagement by the piston to absorb axial vibrations. A spline type connection prevents relative rotation between the piston and the cylinder. The cylinder is mounted for arcuate turning in a chamber within the casing, but the cylinder has vanes which are interposed between vanes fixed to the casing, and elastomeric material between the vanes of the cylinder and the vanes of the casing absorbs torsional vibrations being transmitted between the cylinder and the casing. The elastomeric material is preferably formed in situ as an integral mass in the chamber of the casing by pouring the elastomeric material in a fluid state into the chamber.

8 Claims, 3 Drawing Sheets

FLOATING CUSHION SUB

DESCRIPTION OF THE INVENTION

1. Technical Field

This invention relates to a cushion sub of a type for absorbing vibrations being transmitted to a drill head by a drill pipe during the drilling of a bore hole.

2. Background Art

It is well known to include a cushion sub below the drill head of a drilling rig and through which the turning force of the drill head is transmitted to the uppermost drill pipe section to thereby rotate the drill string within the bore being drilled. Such cushion subs have taken a number of different forms, the design of which takes into account different features of the drilling operation in association with which the cushion sub will be used. For example, it is common in a drilling operation to force the drilling bit into engagement with the bottom of the bore and to achieve the cutting action due to rotation motion only of the bit. A cushion sub designed for this type of drilling must be capable of absorbing a significant portion of both the torsional and axially vibrations developed by the cutting action of the bit, but most importantly, it must be designed to accommodate high torsional forces. In the use of downhole hammer drilling, drilling is achieved by additional axial vibrating of the drill bit usually by way of a compressed fluid transmitted to a hammer means at the bit location. While the cushion sub used in the past for this type of drilling had to be capable of transmitting a drilling torque as well, the cushion sub was primarily designed to prevent the transmission of high axial vibration forces to the drilling head. Thus, it did not need the same type of means to prevent the transmission of large torsional vibration forces as in the previously described cushion sub. In this regard one might compare the two different type of structures of applicant's U.S. Pat. No. 5,224,898, Johnson, and U.S. Pat. No. 4,759,732, Jul. 26, 1988, Johnson.

More recently, however, different practices of drilling have developed. For example, in the drilling of pile holes for construction and in the drilling of blast holes used in mining, downhole hammering has been used for drilling holes of much larger diameter than previously made. In an attempt to cope with the higher torsion vibrations developed under these conditions, cushion connectors of the type shown in U.S. Pat. No. 5,224,898 have been utilized. This has not proven completely satisfactory, however, in that the resilient means used in the connector of this patent has not been designed for the transmission of the axial forces present in the downhole hammer type drilling.

DISCLOSURE OF INVENTION

Accordingly, it is an object of the present invention to provide a cushion sub having both axial and torsional vibration absorbing characteristics capable of effectively handling the types of forces being experienced in modern drilling techniques.

The cushion sub of the present invention, which is used for connection between a driving member and a driven member in a drill string to effectively absorb both torsional and axial vibrations in the drill string, is of the type including a main body having an outer casing member. The casing member includes a first end cap which is provided with a first connection means at one end of the main body for rigid connection to one of the driving and driven members of the drill string, usually the driving member. A cylinder member is disposed within the outer casing member and defines an inner cylinder chamber, and a piston member is disposed within the cylinder chamber for axial movement between extreme inward and outward positions. A piston shaft extends from the piston member through the other end of the casing member. The piston shaft has second connection means at a free end thereof for rigid connection to the other of the driving and driven members of the drill string, usually the driven member. The cylinder member has internal spline means cooperating with external spline means on the piston member for preventing relative rotation between the piston member and the cylinder member while permitting the axial movement of the piston member relative to the cylinder member between the inward and outward positions. Cushion means is provided at opposite ends of the cylinder chamber for engagement by the piston in either of the extreme positions for absorbing axial vibrating and preventing transmission thereof between the piston member and the cylinder member.

According to one aspect of the present invention, the cylindrical member has an outer surface disposed radially inward from an inner surface of the casing member so as to form an annular space therebetween. First circumferentially spaced vane members project radially outward from and are integrally formed with the outer surface of the cylinder member, the vane members extending axially along the outer surface within the annular space. Second radially inward projecting vane members are integrally formed with the inner surface of the casing member, the second vane members being circumferentially spaced from each other and being disposed between and circumferentially spaced form the first vane members. Resilient cushion means is disposed in the annular space between and separates the first and second vane members, so as to absorb torsional vibrations and thereby prevent transmission of torsional vibrations between the cylinder member and the casing member.

According to another aspect of the present invention, the casing member has a cylindrical inner surface defining a closed chamber, and a plurality of first, circumferentially spaced, vane members project radially inward from the inner surface of the casing member. A plurality of second, circumferentially spaced vane members are affixed to the cylinder member and project radially outward between, but circumferentially spaced between the first vane members in the closed chamber. A resilient cushion medium occupies the closed chamber and separates the first and second vane members. The cushion medium formed in situ in said closed chamber by injecting said medium in a fluid state into said closed chamber is thereby bonded to said first and second vane members so that the cushion medium effectively absorbs torsional vibrations being transmitted between the cylinder member and the outer casing.

BRIEF DESCRIPTION OF DRAWINGS

In the accompanying drawings, which show one preferred embodiment of the present invention, as an example.

BEST MODE OF CARRYING OUT INVENTION

Figure 1:
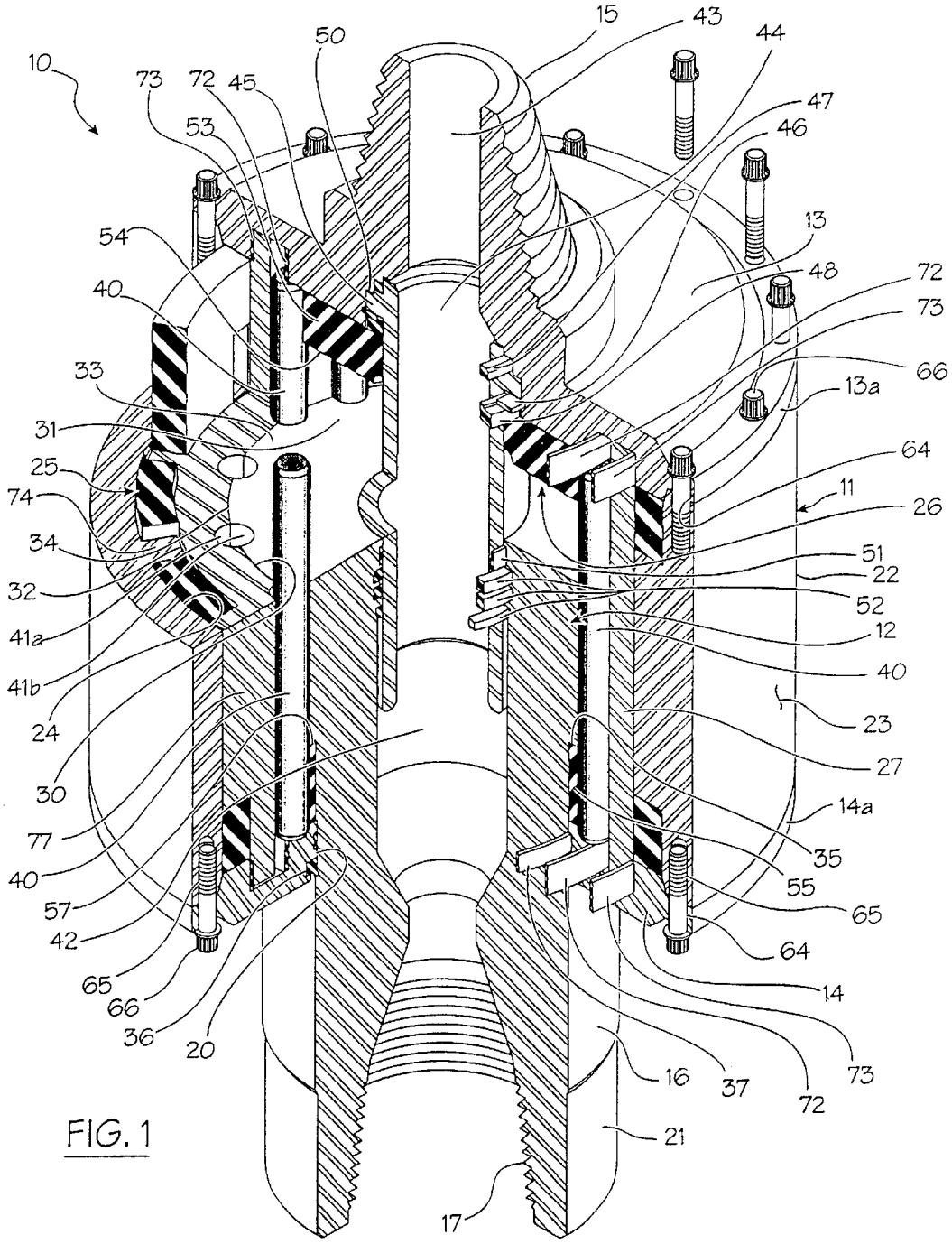
FIG. 1 is a side perspective view of a cushion sub of the present invention with parts cut away or removed to illustrate the interior components of the cushion sub.

Referring now to the drawings, in which like reference characters are used to denote like parts in the following description, the cushion sub is generally denoted by the reference character 10. Cushion sub 10 has a main body 11 including an upper cap 13 and a lower cap 14. Formed concentrically and integrally with the upper cap 13 is a pin connection 15 in the usual form of a tapered threaded portion. Disposed within the main body 11 is a piston member 12 formed integrally with a cylindrical shaft 16 which projects downwardly through a circular opening 20 in the lower cap 14. Within a lower end 21 of the shaft 16 is formed a box connector 17 formed by the usual tapered threaded opening. While the present description refers to the upper cap 13 and the lower cap 14, it is to be appreciated that the sub cushion 10 need not be orientated in the position shown in the drawings. However, normally the pin connection 15 is connected directly to the output of the rotary drive of the drilling rig, this being referred to herein as the drive portion of the drill string. In such an arrangement the box connector 17 is directly connected to the upper most section of the actual drill string, hereinafter referred to as the driven portion of the drill string.

The main body 11 includes an outer housing or casing member 22 having an outer cylindrical surface 23 and an inner cylindrical surface 24, the casing member 22, which together with the upper cap 13 and lower cap 14 form an inner closed chamber which houses the torsional vibration cushioning means 25.

The piston member 12 is disposed within a housing in the form of a cylinder member 27 which contains axial vibration cushioning means 26. The cylinder 27 is concentrically disposed within the casing member 24 and has an inner cylindrical surface 30 defining a cylinder chamber 31 and an outer cylindrical surface 32 which is spaced radially inward of the inner surface 24 of the casing member 22 so as to define therebetween an annular space which forms the above-mentioned closed chamber within the casing member 22.

The piston member 12 has a top surface 33 and an outer cylindrical surface 34 which is of substantially the same diameter as the inner cylindrical surface 30 of cylinder member 27, so as to be axially slidable within the cylinder chamber 31. In the embodiment illustrated, the shaft 16 of the piston member 12 is integrally formed with the piston member, and is of smaller diameter so as to form a lower piston surface or shoulder 35. A surface defining the circular opening 20 through which the shaft 16 passes is provided with annular grooves which receive a seal 36 and a wear ring 37.

The engaging inner surface 30 of the cylinder member 27 and the outer surface 34 of the piston member 12 are provided within inter-engaging spline means which prevents relative rotation of the cylinder member and piston member, while permitting axial movement of the piston member relative to the cylinder member. Thus, torque can be transmitted from the cylinder member 27 to the piston member 12. The spline means is in the form of a plurality of elongated drive pins 40 of circular cross-section, each received in mating, substantially semi-circular, axially extending grooves 41*a*, 41*b*, formed in the inner surface 30 of the cylinder member 27 and the outer surface 34 of the piston member 12, respectively. The drive pins 40, extend the full length of the cylinder chamber 31. In FIG. 1, two of the drive pins have been removed to better illustrate the relationship of the matching grooves 41*a*, 41*b*.

The piston member 12 is hollow so as to define an internal passageway 42 axially therethrough, the passageway 42 extending through the shaft 16 of the piston as well so as to be in fluid communication with the interior of a driven portion of the drill string connected by way of the box connector 17 to the piston member. The pin connection 15 of the upper cap 13 also has an internal passageway 43 extending therethrough so as to communicate with the section of a drill string which forms the drive portion, normally the rotary drive, connected to casing 11 of the cushion sub by way of the upper cap 13.

A cylindrical sleeve member 44 has an upper end thereof disposed with a lower portion of the internal passageway 43 of the upper cap 13 and a lower end thereof disposed within an upper portion of the passageway 42 of the piston member 12, the sleeve member 44 thus placing the internal passageway 43 in fluid communication with the internal passageway 42. Accordingly fluid is free to flow through the cushion sub 10 from an upper driven member of the drill string to a lower driven member. The sleeve member 44 has a radially projecting annular flange 45 encircling its upper end. The flange 45 is retained against a shoulder 50 formed within an enlarged lower portion of the internal passageway 43 in the upper cap 13 by way of a retaining ring 46. A seal 47 is located above the flange 45, and a lower sealing ring 48 is located below the retaining ring 46 so as to isolate the cylinder chamber 31 from the internal passageway 43. At the upper end of the internal passageway 42 in the piston member there is provided a plurality of annular grooves, the upper one of which contains a wear ring 51, and the others of which contain seal means 52, to isolate the cylinder chamber 31 from the internal passageway 42.

Located in the upper end of cylinder chamber 31 is an annular shaped cushion member 53 which forms an upper part of the axial vibration cushion means 26. As may be noted the cushion member is of considerable thickness and has a lower surface 54 which is engaged by the top surface 33 of the piston member 12 when the piston member is in its extreme upper position. The cushion means 26 further includes a lower cushion member 55 which is of a thick cylindrical shape having a lower end surface 56 abutting an upper surface of the lower cap 14. The cushion member surrounds the shaft 16 of the piston and provides an upper surface 57 disposed to be engaged by the lower surface of the piston member provided by shoulder 35. Thus, as the piston member 12 approaches its lower extreme position, its downward movement relative to the casing member 22 is cushioned by the lower cushion member 55 of the axial vibration cushion means 26. It can be seen, therefore, that the piston members 12 has relatively free or floating movement within a major portion of its axial travel intermediate the lower surface 54 of the upper cushion 53 and the upper surface 57 of the lower cushion member 55, while being prevented from axial rotation relative to the cylindrical member 27 by way of the spline means between the piston member 12 and the cylinder member 27. The cushion means 26 is adapted to absorb axial transmitted vibration, however, when the piston means is in either of its two opposite axial positions.

The opposite end caps 13 and 14 and the cylindrical casing 22 are separately formed, the end caps having peripheral flange 13*a* and 14*a* respectively, provided with opposed machined surfaces 60 and 61, respectively, for tight sealing engagement with opposed machined end surfaces 62 and 63 of the casing 22. There are plurality of bores 64 provided through the flanges 13*a* and 14*a*, which align with a plurality of threaded bores 65 extending axially into the opposite ends of the casing 22. A plurality of cap screws 66 pass through the bores 64 and are threaded into the threaded bores 65 to hold the end caps 13, 14 and casing 22 tightly together and to enclose the inner closed chamber immediately within the inner cylinder surface 30 of the casing 27, the inner closed chamber housing the torsional vibration cushioning means 25. The radial inward extent of the inner closed chamber is defined by the outer surface 32 of the cylinder member 27.

Formed in the opposed bottom and top inner surfaces of the upper and lower end caps 13, 14 are annular channels 67, 68, respectively. The annular channels are concentrically disposed relative to the central longitudinal axis of the cushion sub 10. At the opposite ends of the cylinder member 27 the inner and outer cylindrical surfaces are machined to provide axially projecting end flanges 70 and 71 which are received in the annular channels 67 and 68, respectively. The flanges 70 and 71 are of smaller cross section than the annular grooves so as to contain between the flanges and the walls of the channels, inner and outer wear rings 72 and 73. The distance between the opposite outer end of the flanges 70 and 71 is slightly less than the distance between the bottom walls of the channels 67 and 68, so that when the end caps are secured in place by the cap screws 66, with the presence of the wear rings 72 and 73, the cylinder member 27 is not clamped against relative rotation within the casing member 22.

Figure 2:
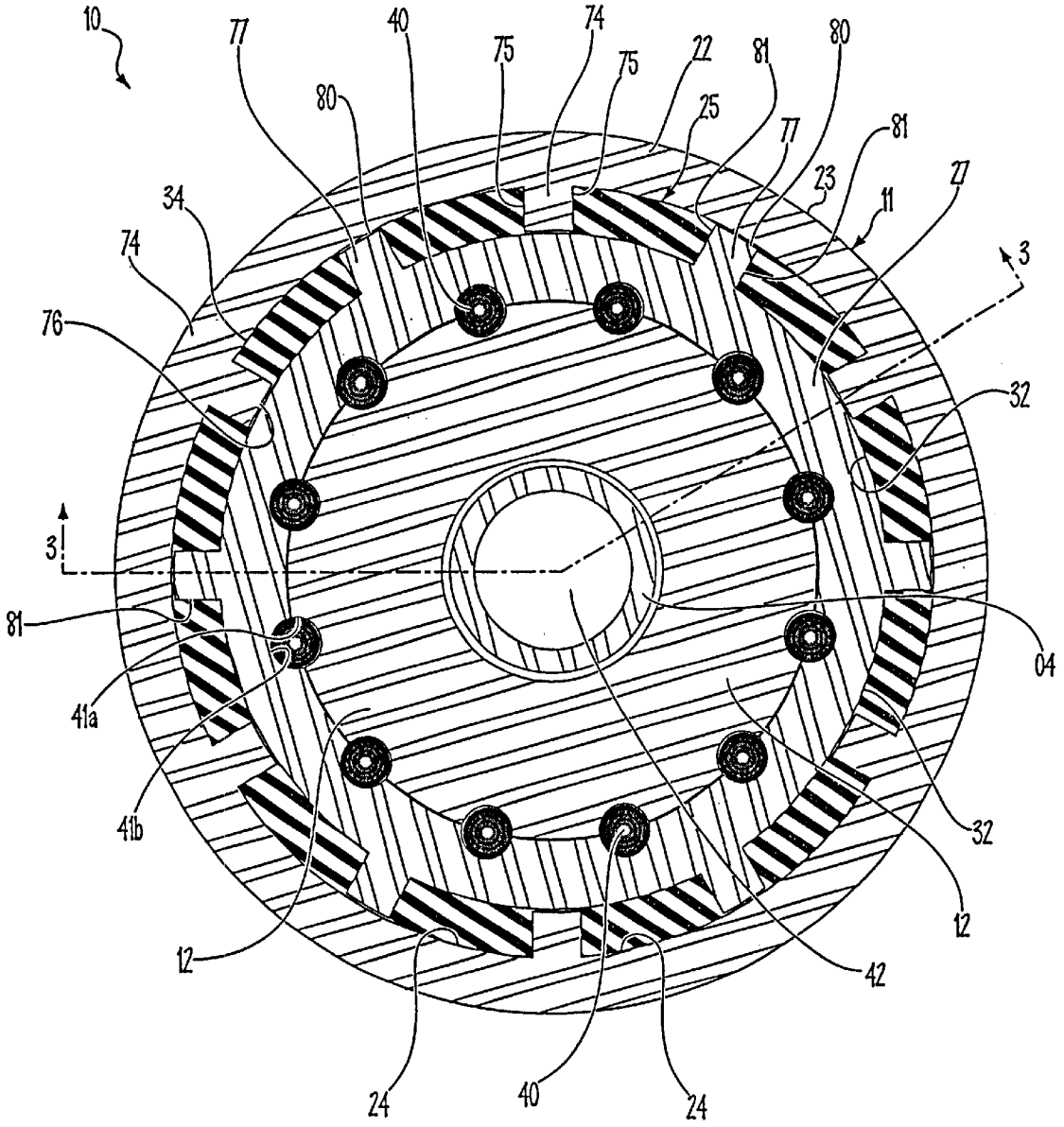
FIG. 2 is a sectional view taken transversely through the cushion sub of FIG. 1, and as would be seen from a line 2—2 of FIG. 3.
Figure 3:
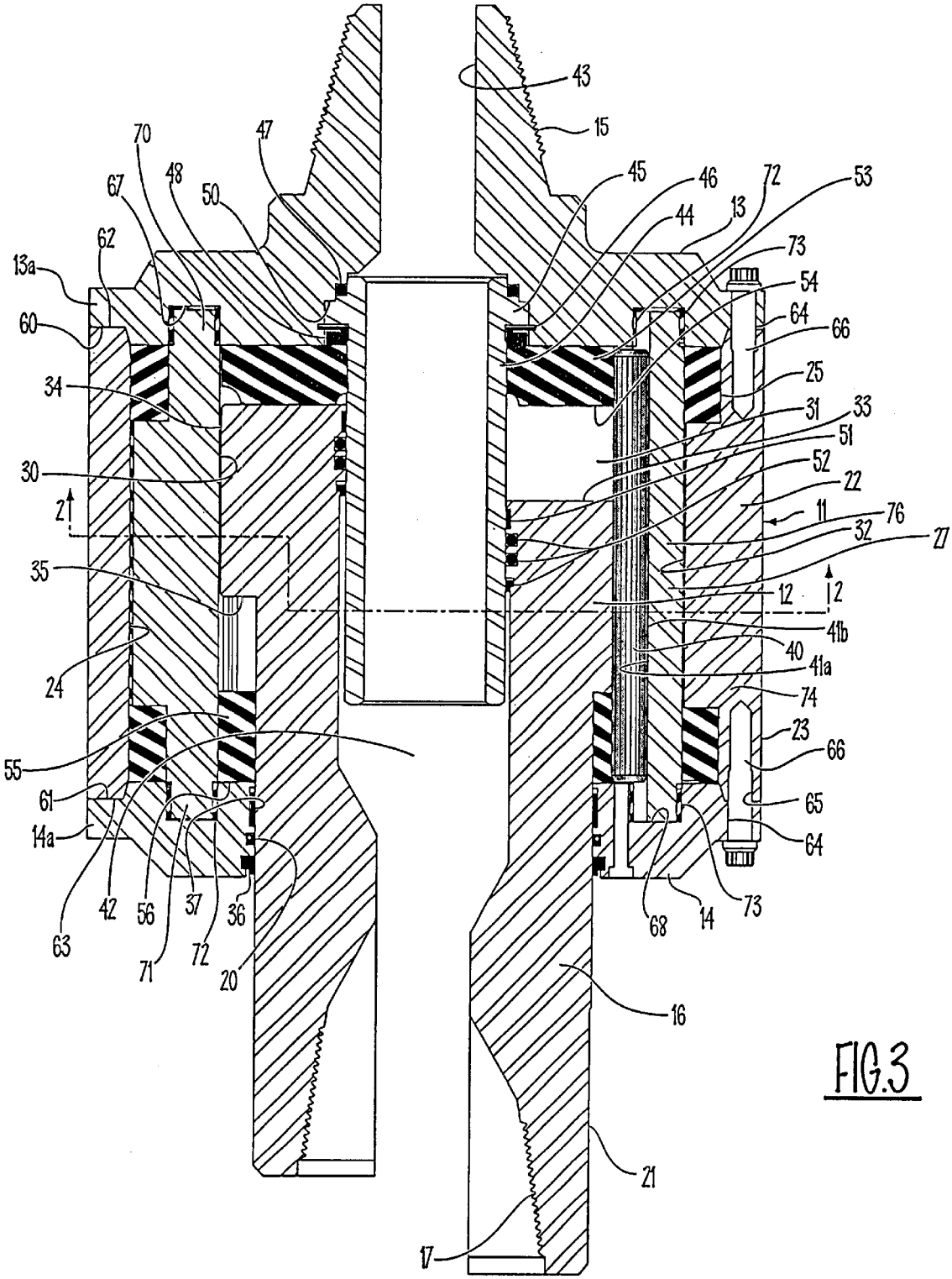
FIG. 3 is a longitudinal sectional view as seen from line 3—3 of FIG. 2, and showing the piston in two extreme opposite positions on opposite sides of the center-line of FIG. 3.

The cylinder member 27 is thus positioned concentrically within the casing member 22, and the inner closed chamber of the cushion sub 10, which contains the torsional vibration cushioning means 25, is defined within the annular space between the inner cylindrical surface 24 of the casing member 22 and the outer cylindrical surface 32 of the cylinder member 27. The torsional vibration cushioning means 25 further includes a first set of radially inward projecting vanes 74 which are cast integral with the casing member 22. The vanes may alteratively be welded or otherwise affixed to the inner surface 24 of the casing member 22. The vanes 74 are shown as extending axially a distance which is a substantial portion of the length of the inner closed chamber formed within the casing member 22. The individual vanes 74, which have side faces 75, 75, (FIG. 2) are circumferentially spaced about the inner cylindrical surface 24 and extend radially inward a distance slightly less than the radial depth of the annular space between the inner cylindrical surface 24 of the casing member and the outer cylindrical surface 32 of the cylinder member 27 so that inner edge faces 76 of the vanes 74 do not engage the outer cylindrical surface 32.

The torsional vibration means 25 further includes a second set of vanes 77 which project radially outward from the outer cylindrical surface 32 of the cylinder member 27. The vanes 77 again may be cast or otherwise integrally formed with the cylinder member 27 or be affixed by some other means to the cylindrical surface 32 so as to project radially outward a distance slightly less than the radial depth of the annular space forming the closed chamber of the torsional vibration means 25. Thus, outer edge faces 80 of the vanes do not engage the inner cylindrical surface 24 of the casing member 22. The vanes 77 have side faces 81, 81 and are circumferentially spaced on the outer surface 32. In the assembled state the vanes 74 and 77 of the two sets are circumferentially separated by cushioning means 82 of an elastomeric material. The cushioning means 82 may be formed of an elastomeric type material, such as a polyurethane material, located between the opposed side faces 75 and 81 of the two sets of vanes 74, 77. The presence of the cushioning means 82 between the opposing faces of the two sets of vanes resists movement of the otherwise separated vanes 74, 77 towards each other, thereby providing a driving torque from vanes 74 to vanes 77 and at the same time absorbing torsional type vibrations and preventing the transmission of substantial torsional vibrations from the cylinder member 27 to the casing member 22.

The illustrated embodiment includes features accomplishing the absorbing of both torsional and axial vibration in a compact arrangement wherein the cushioning means are located within chambers isolated from the environment. The illustrated embodiment, wherein the torsional vibration cushion means 25 concentrically encompasses the axial vibration cushioning means 26, provides a compact cushion sub capable of effectively absorbing vibrations of the type encountered in modem drilling techniques. The cushioning components between the adjacent vanes 74 and 77 can be formed of individual elastomeric elements which provide a cushion sub of compact design capable of absorbing high torsional vibrations. The cushion sub of the present invention is of even a more efficient design and is capable of providing a longer wear life, if it is formed in a different manner. The cushion means 82 may be formed by first assembling the components making up the cushion sub but leaving the chamber defined between the casing member 22 and the cylinder member 27 empty, and then with the casing member 22 and cylinder member 27 properly oriented in relation to each other so that each vane 77 is centered between adjacent pairs of vanes 74, an elastomeric medium in a fluid state is poured into the annular space between the casing member 22 and the cylinder member 27 so as to fill the chamber encompassing the vanes. This in situ forming of the cushioning means 82 results in the medium bonding to the vanes and also to the surfaces of the casing member 22, cylinder member 27 and substantially filling the chamber. This bonding in addition to the confinement of the medium provides for effective vibration absorption and extended cushion life. The sealing affect achieved by this type of formation of the elastomeric cushioning medium further prevents the entry of contaminants into the cushion sub.

While the single embodiment disclosed in the accompanying drawings shows the two sets of interdisposed vanes of the casing member 22 and the cylinder member 27 located in an annular closed chamber in order that the cushion medium can be injected into the chamber and thus forms the solidified medium between the vanes, an alternative embodiment utilizing this same concept of the invention can achieves much the same advantages. For example, the chamber could be formed in a space disposed adjacent one end of the cylinder member 27 and circumferentially enclosed by the casing member. The vanes corresponding to the disclosed vanes 77 would extend axially from a closed end of the cylinder member in such an arrangement, and be interdisposed by radially inward projecting vanes affixed to the inner surface of the casing member and corresponding to vanes 74. Again the cushioning medium would be formed in situ by injecting the medium in a fluid state into the closed chamber.

Additional alternative embodiments within the spirit of the present invention as defined in the accompanying claims will be obvious to those skilled in the art.

What is claimed is:

1. A cushion sub for connection in a drill string to absorb torsional and axial vibrations in the drill string, said cushion sub comprising:

a main body, a first cylinder member defining a cylinder chamber therewithin, a piston member disposed within said cylinder chamber for axial movement within said cylinder chamber between extreme inward and outward positions, said cylinder member having internal spline means cooperating with external spline means of said piston member for preventing relative rotation between said piston member and said first cylinder member while permitting said axial movement of said piston member between said inward and outward positions relative to said first cylinder member, cushion means at opposite ends of said cylinder chamber for engagement by said piston member in either of said extreme positions for absorbing axial vibrations and preventing transmission of said axial vibrations between the piston member and said first cylinder member, characterized by:

said main body including an outer casing member, and a first end cap having a first connection means at one end of said main body for rigid connection to one of a driving portion and a driven portion of a drill string, said first cylinder member being disposed within said outer casing member, a piston shaft extending from said piston member through an end of said casing member opposite to said one end, said piston shaft having second connection means at a free end thereof for rigid connection to the other of a driving portion and a driven portion of a drill string, said first cylinder member having an outer surface radially disposed inwardly from an inner surface of said casing member to thereby form an annular space therebetween, first axially extending, circumferentially spaced vane members, integrally formed with the inner surface of said casing member, and projecting radially inward into said annular space, second radially outward projecting, circumferentially spaced, vane members integrally formed on said outer surface of said first cylinder member and extending axially therealong within said annular space, said first vane members being disposed between and circumferentially spaced from said second vane members within said annular space, resilient cushion means disposed in said annular space between and separating said first and second vane members for absorbing torsional vibrations and thereby preventing transmission of said torsional vibrations between said cylinder member and said casing member.

2. A cushion sub as defined in claim 1, and wherein;

said casing member is a second cylindrical member closed at a first end by said first end cap at said one end of said main body, and further comprising:

a second end cap affixed to an end of said second cylindrical member opposite said one end of said main body, said second end cap defining a central opening therethrough receiving said piston shaft, said end caps closing opposite ends of said annular space to thereby form a closed chamber containing said first and second vanes and said resilient cushion means.

3. A cushion sub as defined in claim 2, wherein said resilient cushion means comprises a resilient elastomeric medium occupying said closed chamber and being bonded to said vanes, said outer surface of said cylinder member, and said inner surface of said casing member.

4. A cushion sub as defined in claim 3, wherein said elastomeric medium is formed in situ by pouring said elastomeric medium in a fluid state into said closed chamber.

5. A cushion sub as defined in claim 2, 3 or 4, wherein said end caps have annular shaped channels formed in inner opposed faces thereof, and said cylinder member has opposite circular end flanges received in said channels and allowing turning movement of said cylinder member relative to said casing member.

6. A cushion sub for connection in a drill string to absorb torsional and axial vibrations in the drill string, said cushion sub comprising:

a main body, a cylinder member defining a cylinder chamber therewithin, a piston member disposed within said cylinder chamber for axial movement therein between extreme inward and outward positions, said cylinder member having internal spline means cooperating with external spline means of said piston member for preventing relative rotation between said piston member and said cylinder member while permitting said axial movement of said piston member between said inward and outward positions relative to said cylinder member, cushion means at opposite ends of said cylinder chamber for engagement by said piston in either of said extreme positions for absorbing axial vibrations and preventing transmission thereof between the piston member and the cylinder member, characterized by:

said main body having an outer casing member including a first end cap having a first connection means at one end of said main body for rigid connection to one of a driving portion and a driven portion of a drill string, said cylinder member being concentrally disposed within said outer casing member, a piston shaft extending from said piston member through an end of said casing member opposite to said one end, said piston shaft having second connection means at a free end thereof for rigid connection to the other of a driving portion and a driven portion of a drill string, said casing member having a cylindrical inner surface defining a casing chamber therewithin, a plurality of circumferentially spaced first vane members affixed to said casing member and disposed within said casing chamber, said first vane members projecting radially inward from said inner surface of said casing member, a plurality of circumferentially spaced second vane members affixed to said cylinder member and projecting radially outward between said first vane members in said casing chamber, a resilient cushion medium occupying said casing chamber and circumferentially spacing said first vane members from said second vane members, said cushion medium being formed in situ by being poured in a fluid state into said casing chamber and thereby bonding to said first and second vane members on solidifying, whereby the cushion medium on solidification absorbs torsional vibrations being transmitted between the cylinder member and the casing member.

7. A cushion sub as defined in claim 6, wherein said cylinder member has an outer cylindrical surface spaced radially inward of said inner cylindrical surface of said casing member to thereby form an annular space defining said casing chamber, and further comprising:

a second end cap, said end caps being affixed to opposite end of said casing member and closing opposite ends of said annular space, said first vane members projecting inwardly toward the outer surface of said cylinder member, said second vane members being affixed to and projecting outward from said outer surface of said cylinder member toward the inner surface of said casing member.

8. A cushion sub as defined in claim 7, wherein said cylinder member has flange means at opposite ends thereof cooperating with mounting means in said end caps for permitting relative rotational movement of said cylinder member in either direction within said casing member.

* * * * *

UNITED STATES PATENT AND TRADEMARK OFFICE

CERTIFICATE OF CORRECTION

PATENT NO. : 6,332,841 B1
DATED : December 25, 2001
INVENTOR(S) : Douglas C. Secord It is certified that error appears in the above-identified patent and that said Letters Patent is hereby corrected as shown below:

Title page,
Item [56], References Cited, under "U.S. PATENT DOCUMENTS" is modified to include the following additional patents:

| | | |
|---|---|---|
| -- 4,552,230 | 11/1985 | Anderson et al. |
| 4,844,181 | 7/1989 | Bassinger |
| 6,098,726 | 7/2000 | Taylor et al. -- |

Signed and Sealed this

Third Day of September, 2002

*Attest:*

*Attesting Officer*

JAMES E. ROGAN
*Director of the United States Patent and Trademark Office*